US007392548B2

(12) United States Patent
Rou

(10) Patent No.: US 7,392,548 B2
(45) Date of Patent: Jul. 1, 2008

(54) NAPKIN HOLDER

(76) Inventor: Hoi Jin Rou, No. 23-903 Shinbanpo 3rd Apt., 1-1 Banpo-dong, Seocho-gu, Seoul 137-040 (KR)

( * ) Notice: Subject to any disclaimer, the term of this patent is extended or adjusted under 35 U.S.C. 154(b) by 346 days.

(21) Appl. No.: 11/194,925

(22) Filed: Aug. 2, 2005

(65) Prior Publication Data

US 2006/0225181 A1 Oct. 12, 2006

(30) Foreign Application Priority Data

Apr. 12, 2005 (KR) ..... 10-2005-0030198

(51) Int. Cl.
*A45F 5/04* (2006.01)

(52) U.S. Cl. ..... 2/52; 24/9

(58) Field of Classification Search ..... 2/52, 2/49.1, 48, 51, 338, 340, 341, 49.3–49.5, 2/50, 304, 306, 309, 311–315, 323, 335; 24/7, 9, 30.5 P, 30.5 S, 298, 302, 8, 3.13, 24/30.5 R, 300, 301, 16 PB, 3.3, 3.4, DIG. 29, 24/563, 545, 546, 547; D2/627; 224/257
See application file for complete search history.

(56) References Cited

U.S. PATENT DOCUMENTS

| | | | | | |
|---|---|---|---|---|---|
| 264,879 | A | * | 9/1882 | Hugill | 24/200 |
| 275,040 | A | * | 4/1883 | Hershey | 248/316.3 |
| 675,108 | A | * | 5/1901 | Perkins | 24/9 |
| D45,576 | S | * | 4/1914 | Thamm | D7/633 |
| D48,357 | S | * | 12/1915 | Thamm | D7/633 |
| 1,864,281 | A | * | 6/1932 | Short | 24/7 |
| 2,017,551 | A | * | 10/1935 | Statter | 24/186 |
| 2,562,386 | A | * | 7/1951 | McCormick | 2/309 |
| 2,571,888 | A | * | 10/1951 | Jesse | 2/49.1 |
| 2,820,269 | A | * | 1/1958 | Wolff | 24/9 |
| 2,835,895 | A | * | 5/1958 | Wells | 2/49.1 |
| 2,865,069 | A | * | 12/1958 | Gamble | 24/9 |
| 5,052,055 | A | | 10/1991 | Mysliwiec | |
| 5,313,669 | A | * | 5/1994 | Rasdell et al. | 2/323 |
| 5,381,588 | A | * | 1/1995 | Nelson | 24/30.5 S |
| 5,414,903 | A | | 5/1995 | Porteous | |
| 5,842,228 | A | | 12/1998 | Krainin | |
| 5,852,849 | A | | 12/1998 | Lansing et al. | |
| 6,161,263 | A | * | 12/2000 | Anderson | 24/545 |
| 6,626,335 | B1 | * | 9/2003 | Dunlop | 224/258 |
| 6,836,899 | B1 | * | 1/2005 | Glasmire | 2/52 |
| 2002/0020044 | A1 | * | 2/2002 | Juda et al. | 24/7 |

FOREIGN PATENT DOCUMENTS

| | | |
|---|---|---|
| JP | 11 36104 | 2/1999 |
| JP | 2001 172807 | 6/2001 |
| JP | 2002 88533 | 3/2002 |

* cited by examiner

*Primary Examiner*—Amy B Vanatta
(74) *Attorney, Agent, or Firm*—Ladas & Parry LLP

(57) ABSTRACT

Disclosed is a napkin holder for easy use and easy carrying. A napkin holder comprises a neck band and the fixing holes are positioned at both end portions of the neck band to hold a napkin, a bib or a towel. The fixing holes may be formed in assorted sizes and various shapes to fix the. napkin, bib and towel, and the neck band may be formed using rubber material like silicone or plastics like soft PVC so that the napkin holder may be formed using elastic materials and used semi-permanently.

6 Claims, 11 Drawing Sheets

NAPKIN HOLDER

CROSS REFERENCE TO RELATED APPLICATION

This application claims priority under 35 USC §119 to Korean Patent Application No. 2005-30198, filed on Apr. 12, 2005, the contents of which are herein incorporated be reference in its entirety.

BACKGROUND OF THE INVENTION

1. Field of the Invention

The present invention relates to a napkin holder. More particularly, the present invention relates to a napkin holder which temporarily holds a napkin, a bib or a towel to prevent clothes from getting dirty.

2. Description of the Related Art

People usually use an apron or a napkin for cleanliness or neatness. However, wearing an apron is a complicated matter because of tying up a neck strip and a waist strip. Additionally, whenever eating, wearing a napkin around the neck or putting a bib on a baby's shoulder is troublesome matters, too.

Accordingly, some napkin holders are developed for easy wearing and easy removal.

For example, U.S. Pat. No. 5,842,228, issued Dec. 1, 1998, is for a napkin holder. The napkin holder includes a neck band wearable around a user's neck and adhesive portions covered by release tabs. The napkin holder using adhesive materials may have the restriction of the weight of the napkin and uncleanness of the napkin. A heavy napkin is easy to be separated from the napkin holder, and a dirty napkin is not attached to the adhesive portion of the napkin holder. Also, the adhesive property of the napkin holder may get weaker and weaker through repeated use.

U.S. Pat. No. 5,852,849, issued Dec. 29, 1998, is for a bib holder. Generally, a bib is used to protect clothes when letting a baby eat food or doing dental treatment, and the bib holder may be used to temporarily hold the bib. The bib holder includes an elongated rod pulled over the shoulder and fasteners mounted on both end portions of the elongated rod. A zipper, a clip, a button or a snap are adapted as the fastener.

U.S. Pat. No. 5,414,903 issued May 16, 1995, is for a dental bib holder. The dental bib holder is used to hold a dental bib in order to screen clothes from by-product of the dental treatment. The dental bib holder includes a strap, a frangible portion connecting the strap and U-shaped clips for holding the dental bib. A user presses the U-shaped clip to separate the clip from a hook and inserts the dental bib between them, to fix the dental bib to the dental bib holder. But, it is difficult to remove the dental bib fixed by the U-shaped clip and the hook. In this case, the user should break the frangible portion to separate the dental bib holder from the user's neck; however the dental bib holder can not be reused after breaking the frangible portion.

SUMMARY OF THE INVENTION

The present invention provides a napkin holder which enables a user to easily put on and take off by oneself.

The present invention provides a napkin holder which is repeatedly reusable over a long period of time.

The present invention provides a napkin holder, the length of which can easily and simply be adjusted by a user.

According to one preferred aspect of the present invention, a napkin holder includes a neck band having fixing holes. The neck band is formed to be wearable around the neck of a human body, and the fixing holes are formed at its both end portions to temporarily hold cloth protection means, such as a napkin, a bib or a towel.

Since the fixing holes positioned at both end portions of the neck band passes and holds a napkin, a bib or a towel, the neck band may be made of elastic material. Also, the fixing hole may be formed in various shapes to hold a napkin, a bib or a towel. For example, the fixing hole may be formed in a shape of a circle, an oval or a polygon, to hold the napkin. Additionally, the fixing hole may be formed in a shape of a cross or an asterisk. Specially, the cross-shaped or asterisk-shaped fixing hole may be composed of several slits radially extending in a shape of wave or zigzag. Moreover, the fixing hole may be composed of one or more V-shaped slits.

To fix a napkin to the napkin holder, a user can use his/her finger to insert the napkin into the fixing hole. The user can grasp the napkin and insert the same into the fixing holes using only one hand, without using two hands.

The napkin holder may be formed using rubber material, such as silicone, or synthetic resin, such as soft PVC or other plastics. Therefore, the napkin holder of the present invention is very light in weight and has many economical advantages over other materials.

The fixing holes may be composed of one or more slits, and the slit may be provided in a shape of a straight line, a waved line or a zigzag line. When using a plurality of slits, the fixing holes may be composed of waved or zigzag slits radially extending from the center of the fixing hole. Since the napkin holder is made of elastic material, pointed pieces defined around the fixing holes may be partially bended to pass the finger and the napkin when the napkin is inserted. After inserting the finger and the napkin, the user pulls out the finger and leaves the napkin engaged with the fixing holes. After the finger is pulled out, the pointed pieces of the fixing holes recover their shapes to hold the napkin using elasticity and friction.

The fixing holes may be composed of V-shaped slits to be formed in a shape of W-shape or teeth. Similarly, pieces defined by the W-shaped fixing holes may be partially bended to pass the finger and the napkin when the napkin is inserted, and may recover their shapes to hold the napkin using elasticity and friction, when the finger is pulled out.

BRIEF DESCRIPTION OF THE DRAWINGS

The present invention will become more apparent to those of ordinary skill in the art by describing, in detail, exemplary embodiments thereof with reference to the attached drawings, wherein like elements are represented by like reference numerals, which are given by way of illustration only and thus do not limit the exemplary embodiments of the present invention.

DETAILED DESCRIPTION OF THE INVENTION

Embodiment 1

Figure 1:
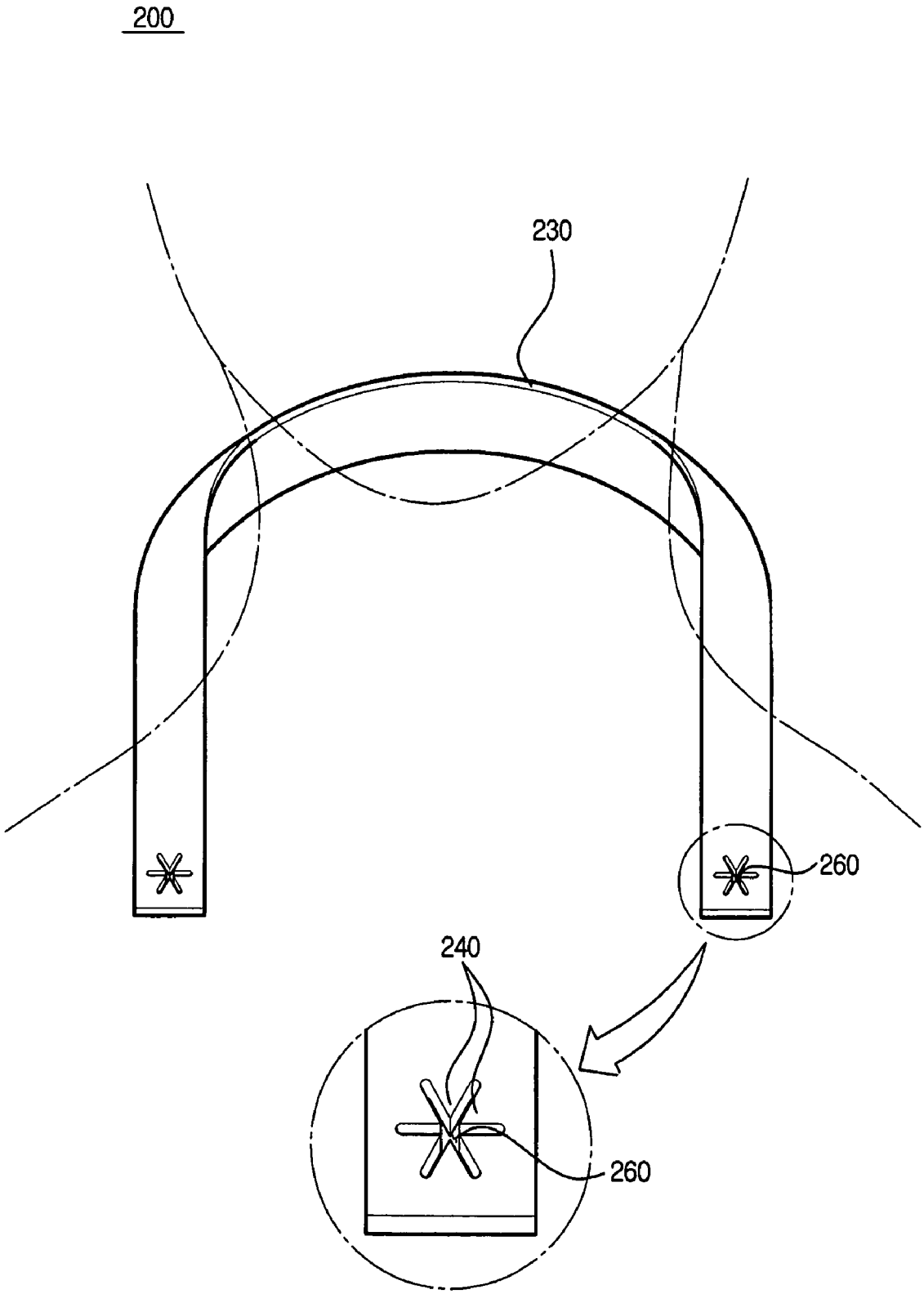
FIG. 1 is a perspective view illustrating a napkin holder according to a first embodiment of the present invention.

FIG. 1 is a perspective view illustrating a napkin holder according to the first embodiment of the present invention.

Referring to FIG. 1, a napkin holder 200 includes a neck band 230 made of elastic material and the neck band 230 has two fixing holes 260 formed in a shape of a slit at its both end portions. The neck band 230 is wearable around a neck and its end portions approach adjacent to the chest when a user puts it 230 on around the neck. So, the fixing holes 260 are positioned adjacent to the chest or below the jaw to hold a napkin, a bib or a towel. When the user inserts a napkin partially into the fixing hole 260, the fixing hole 260 can hold the inserted portion of the napkin and the neck band 230 can temporarily grip the napkin or the likes.

The neck band 230 made of elastic material like silicone is light weight and repeatedly reusable for a long time, such that the napkin holder 200 has many economical advantages. The neck band 230 may be formed using plastics like soft PVC (Poly Vinyl Chloride), synthetic resins like silicone or natural polymers. The materials, such as soft PVC, silicone or natural polymers, are profitable to manufacturers and consumers, because the materials are already in use in various industrial fields.

As shown in FIG. 1, the end portions of the neck band 230 can hold a napkin, a bib or a towel using the fixing holes 260. To fix a napkin to the neck band 230, a user takes a napkin, inserts a portion of the napkin into the fixing hole 260 with his/her finger, and pulls out the inserted finger from the fixing hole 260 to leave the napkin. Specifically, the user can fix the napkin to the napkin holder easily by simple actions of inserting and pulling out a finger.

Since elasticity of the neck band 230 acts, the fixing hole 260 can grasp a napkin, bib, or towel easily and safely, even if the napkin, bib or towel is made of heavy fabrics or gets soiled by food or others.

Referring again to FIG. 1, the fixing holes 260 are formed at both end portions of the neck band 230. Six of the slits are formed radially extending from the center of the fixing hole 260, to provide a fixing hole in a shape of an asterisk. Otherwise, the number of slits or shape thereof may be variously selected.

The number of slits or the position thereof may be modified according to the material of the napkin holder and the kind of the napkin. Although a large number of slits or soft material of slits let a finger and a napkin pass the fixing hole smoothly, they may weaken holding force.

Figure 2:
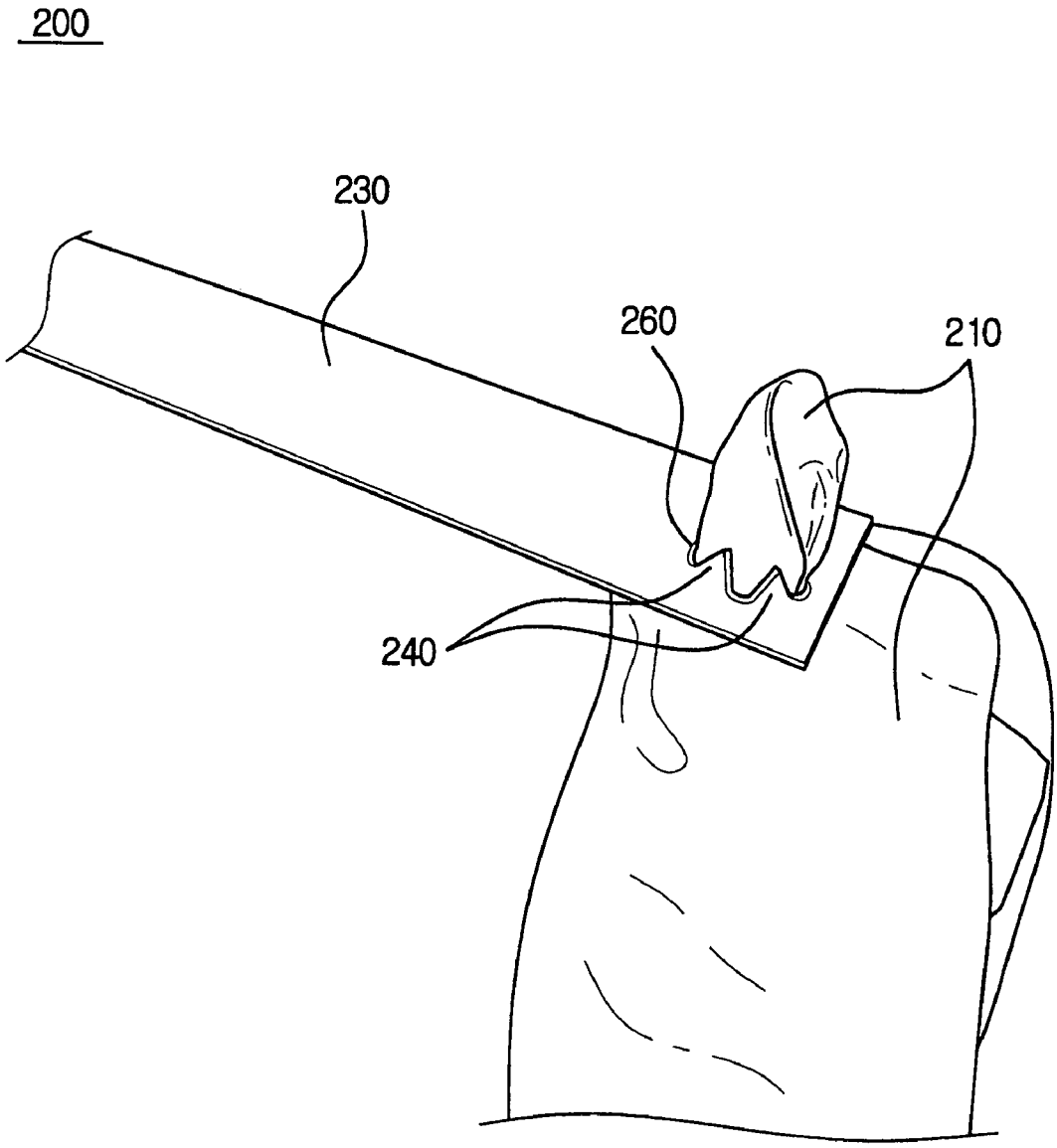
FIGS. 2 and 3 are perspective views illustrating a process to fix a napkin to the napkin holder.
Figure 3:
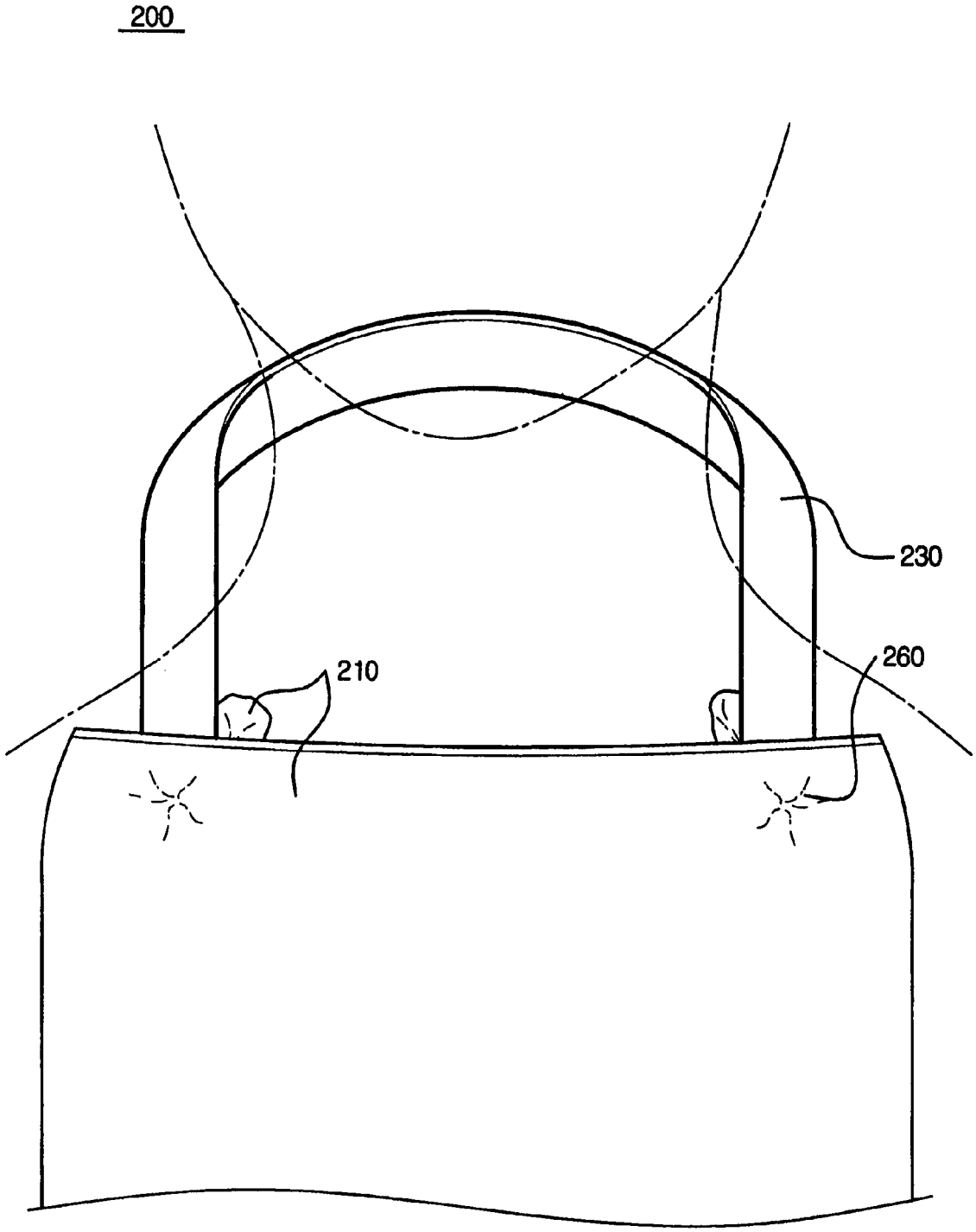

FIGS. 2 and 3 are perspective views illustrating a process to fix a napkin to the napkin holder.

Referring to FIG. 2, a user can insert a napkin 210 partially into the fixing hole 260 using a finger. The fixing hole 260 is composed of six slits radially extending from its center. When the fixing hole 260 is pushed with a finger, the fixing pieces 240 formed around the fixing hole 260 are bended and the napkin 210 partially passes the fixing hole 260. After the finger is pulled out of the fixing hole 260, the fixing pieces 240 recover to their initial state to fix the napkin 210. The napkin 210 is fixed to the fixing pieces 240 using friction force or restoring force.

Referring to FIG. 3, the napkin 210 is held to the neck band 230 by the fixing hole 260. The user can insert the napkin 210 into the fixing hole 260 from outside, or can insert the napkin 210 thereinto 260 from inside.

Embodiment 2

Figure 4:
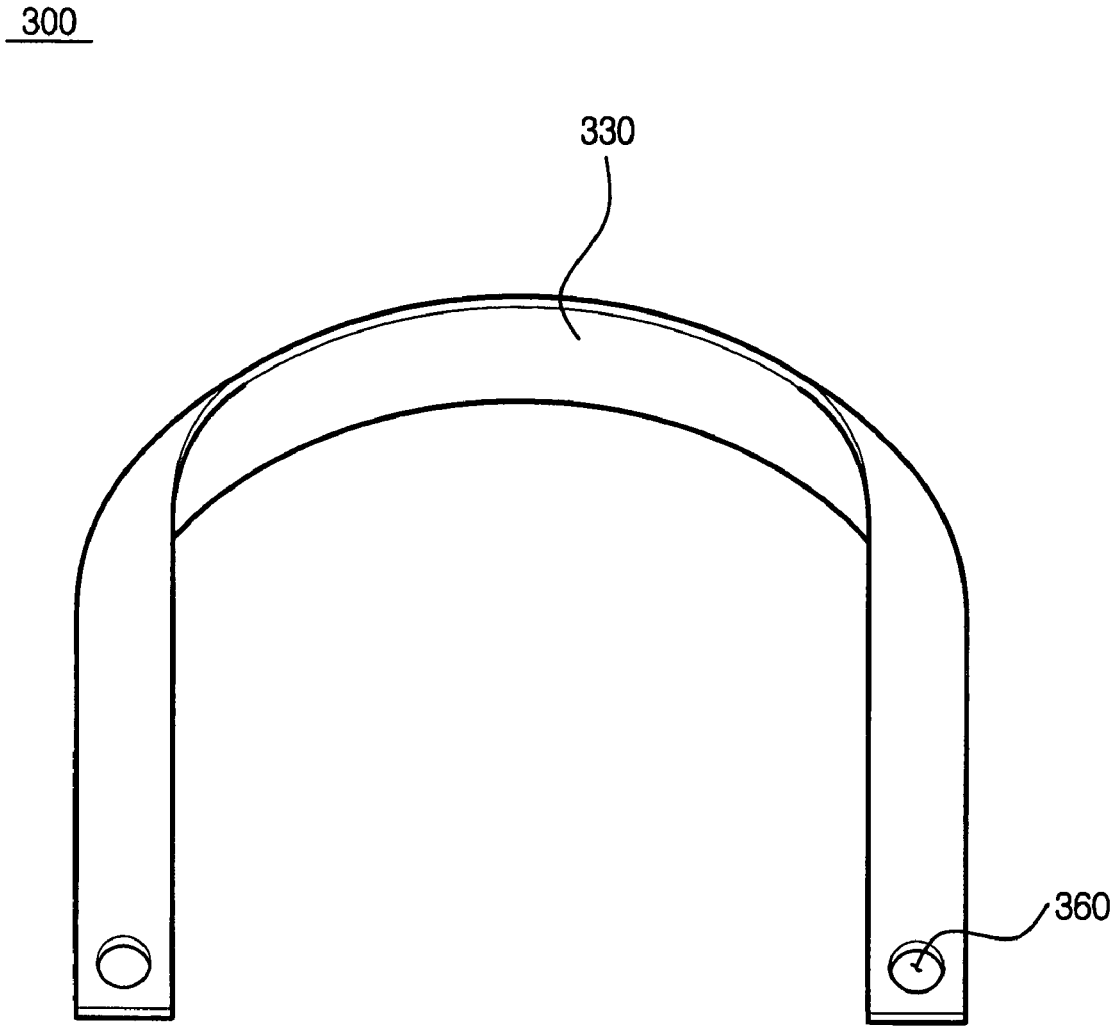
FIG. 4 is a perspective view illustrating a napkin holder according to a second embodiment of the present invention.

FIG. 4 is a perspective view illustrating a napkin holder according to the second embodiment of the present invention.

Referring to FIG. 4, a napkin holder 300 according to the second embodiment includes a neck band 330, and circular fixing holes 360 are provided at both end portions of the neck band 330. The fixing hole 360 is used to temporarily fix a napkin, a bib and likes, into which the napkin is partially inserted to be fixed.

When a user inserts a portion of the napkin into the fixing hole 360 using his/her finger, the elastic fixing hole 360 is partially transformed to pass the napkin and the finger. In case that the finger comes out of the fixing hole 360, the fixing hole 360 is restored to the initial status again to fix the napkin remaining in the fixing hole 360. Additionally, since the napkin made of paper or fabrics has some restoring force and friction force in itself, the napkin can be fixed in the fixing hole 360 for itself.

In case of using the circular fixing hole 360, the size of the fixing hole 360 should be big enough for user to insert the finger and the napkin into the fixing hole 360. Otherwise, the fixing hole 360 may be formed in a shape of oval or polygon.

Embodiment 3

Figure 5:
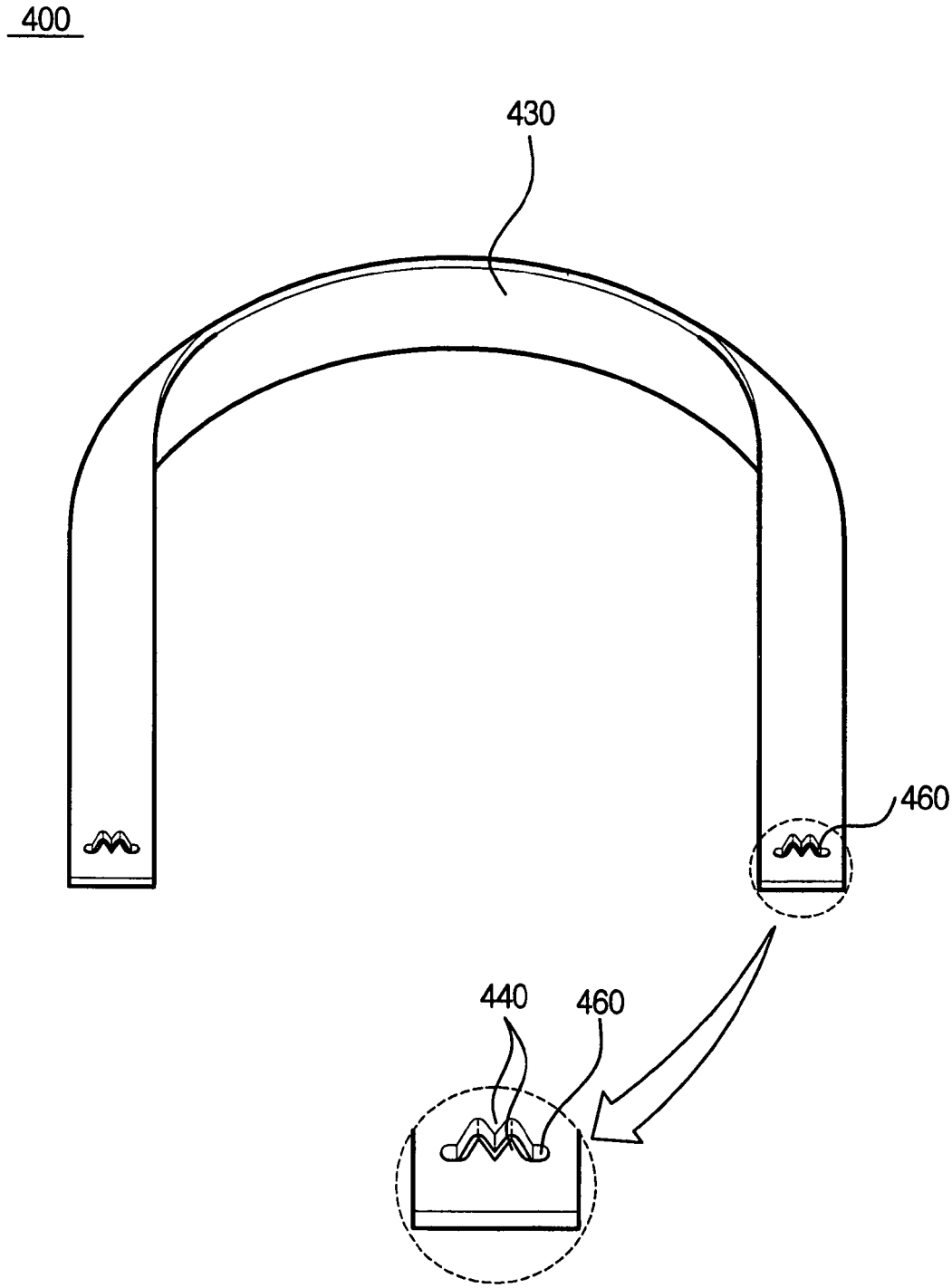
FIG. 5 is a perspective view illustrating a napkin holder according to a third embodiment of the present invention.

FIG. 5 is a perspective view illustrating a napkin holder according to the third embodiment of the present invention.

Referring to FIG. 5, a napkin holder 400 according to the third embodiment also includes a neck band 430. Fixing holes 460 are formed in a shape of W-shape or teeth and positioned at both end portions of the neck band 430. A fixing hole may be composed of one or more V-shaped slits. According to the present embodiment, V-shaped slits are successively connected to form the fixing hole 460 which is in a shape of alphabet "W" or teeth.

A user can insert the napkin or the likes into the fixing hole 460 using a finger. The fixing hole 460 defined by a zigzag slit is W-shaped or teeth-shaped. Fixing pieces 440 are provided by the zigzag slit around the fixing hole 460, and the fixing pieces 440 are partially bended to let a finger and a napkin pass the fixing hole 460. When taking off the finger from the fixing hole 460, the fixing pieces 440 are restored to the initial status to hold the napkin.

Embodiment 4

Figure 6:
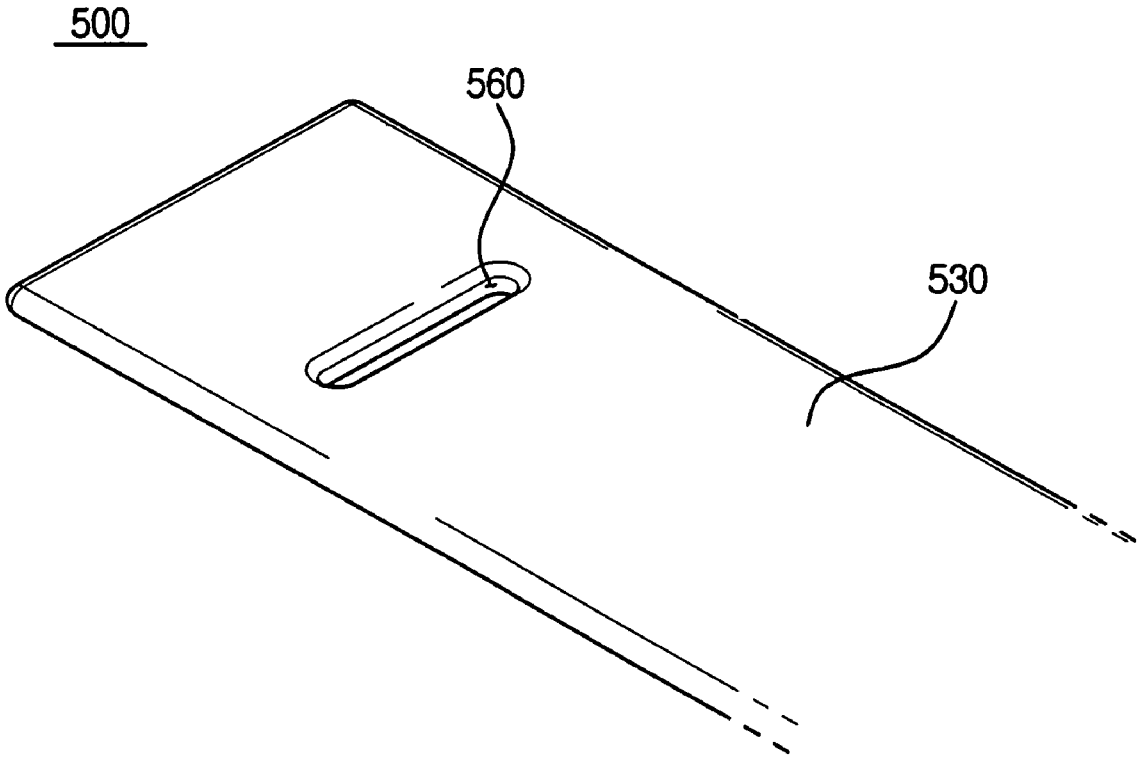
FIG. 6 is a perspective view illustrating a napkin holder according to a fourth embodiment of the present invention.

FIG. 6 is a perspective view illustrating a napkin holder according to the fourth embodiment of the present invention.

Referring to FIG. 6, a napkin holder 500 according to the fourth embodiment includes a neck band 530 wearable around a neck. Fixing holes 560 are formed in a shape of a straight line at both end portions of the neck band 530. A user can insert a napkin or a bib into the fixing hole 560 using a finger. When inserting the napkin into the fixing hole 560, the fixing hole 560 becomes wide and open to pass the napkin. When taking off the finger from the fixing hole 560, the fixing hole 560 becomes narrow and close to hold the napkin.

According to the present embodiment, the fixing hole 560 is provided in a shape of a straight line. However, according to other embodiments, the fixing hole 560 may be provided in a shape of regularly or irregularly waved or zigzag lines.

Embodiment 5

Figure 7:
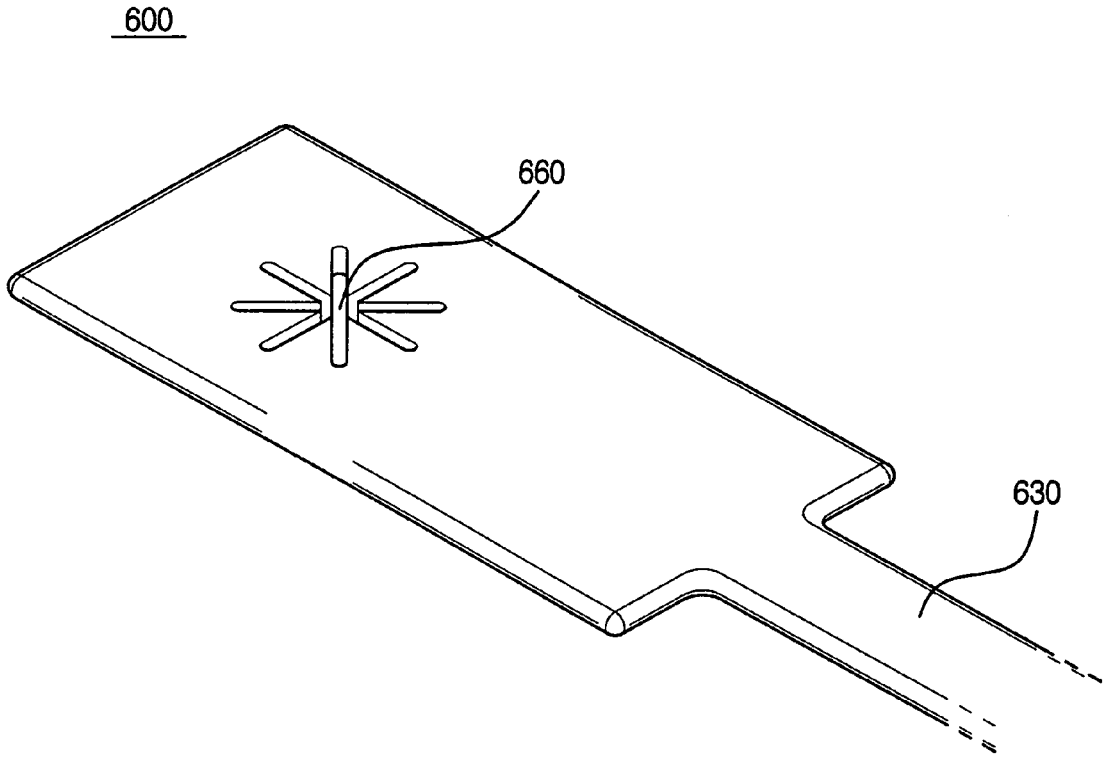
FIG. 7 is a perspective view illustrating a napkin holder according to a fifth embodiment of the present invention.

FIG. 7 is a perspective view illustrating a napkin holder according to the fifth embodiment of the present invention.

Referring to FIG. 7, a napkin holder 600 according to the fifth embodiment includes a neck band 630 wearable around a neck and, similarly to the previous embodiments, fixing holes 660 are provided at both end portions of the neck band 630 to hold a napkin and the likes. The end portions of the neck band 630 have a broader width than the middle portion connecting them. Since the fixing hole 660 is formed at the end portion of the neck band 630, the end portion of the neck band 630 has to be wide enough to form the fixing hole 660, but the connecting portion between the end portions is different from them. Namely, the middle portion of the neck band 630 may be narrower than the end portions, such that the neck band 630 has light weight and good pliability around the neck.

Additionally, the fixing holes 660 resemble an asterisk in shape and are positioned at both end portions of the neck band 630. The fixing hole 660 is composed of 8(eight) slits radially extending from its center according to the present embodiment.

Embodiment 6

Figure 8:
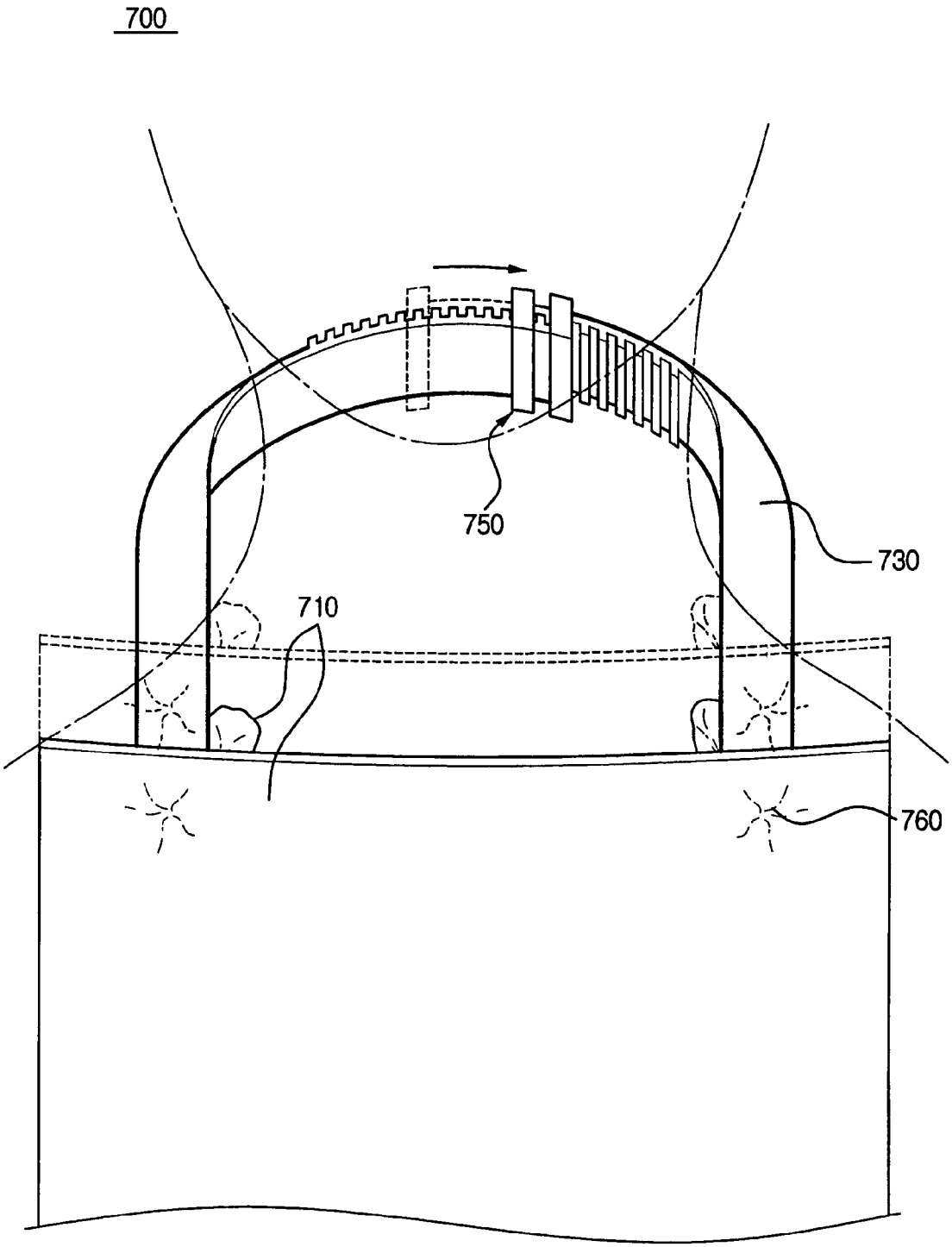
FIG. 8 is a perspective view illustrating a napkin holder according to a sixth embodiment of the present invention.
Figure 9:
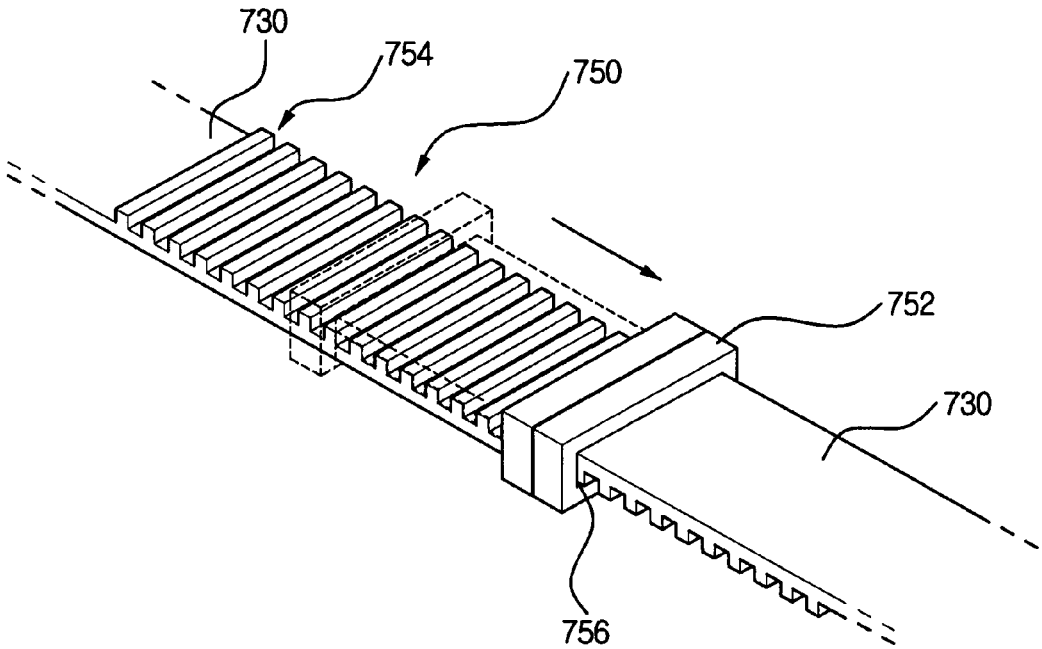
FIG. 9 is a partially enlarged perspective view illustrating a joint loop in FIG. 8.
Figure 10:
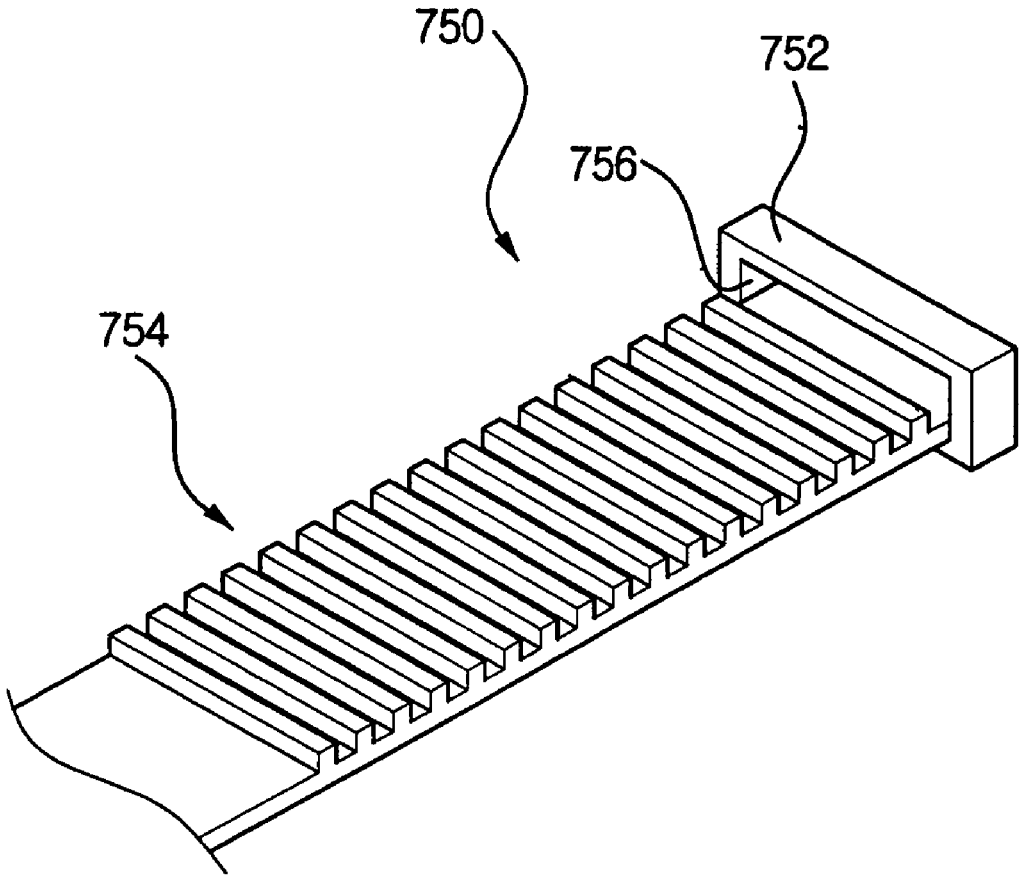
FIG. 10 is a perspective view illustrating a neck band in FIG. 8.

FIG. 8 is a perspective view illustrating a napkin holder according to the sixth embodiment of the present invention, FIG. 9 is a partially enlarged view illustrating a joint loop in FIG. 8 and FIG. 10 is a perspective view illustrating a neck band in FIG. 8.

Referring to FIGS. 8 to 10, two neck bands 730 are mutually engaged to provide a napkin holder 700. Each of the neck bands 730 has a fixing hole 760 formed at one end portion and a joint loop 752 formed at the other end portion, and an uneven portion 754 is provide on one surface adjacent to the joint loop 752.

For reference, the fixing hole 760 of the napkin holder 700 may be formed in various shapes, such as a cross, an asterisk, a circle, an oval, a polygon, a line, etc., as described in previous embodiments.

As shown in FIGS. 9 and 10, the two neck bands 730 are symmetrically engaged. More particularly, one neck band 730 passes the joint loop 752 of the other neck band 730 and the other neck band 730 passes the joint loop 752 of the one neck band 730. Each of the neck bands 730 includes the uneven portions 754 where protrusions are regularly or irregularly arranged along the neck band 730. The uneven portions 754 face and contact with each other to maintain the length of the napkin holder 700. To control the length of the napkin holder 700, the user can separate the uneven portions 754 and adjust the overlapped length of the neck bands 730.

The napkin holder 700 includes a length adjusting section 750 for adjusting the length of the napkin holder, and the length adjusting section 750 may have the uneven portion 754 and the joint loop 752. According to the present embodiment, the joint loop 752 includes a closed joint hole 756 for passing the neck band 730, however, according to other embodiments, a joint loop may be partially open to be formed in a shape of alphabet letter "C".

The uneven portion 754 is provided adjacent to the joint loop 752 and is composed of many protruding sections or recessing sections successively disposed along the neck band 730. The protruding or recessing section in the uneven portion 754 may have a cross section in various shapes, such as a square, a triangle or a circle.

Embodiment 7

Figure 11:
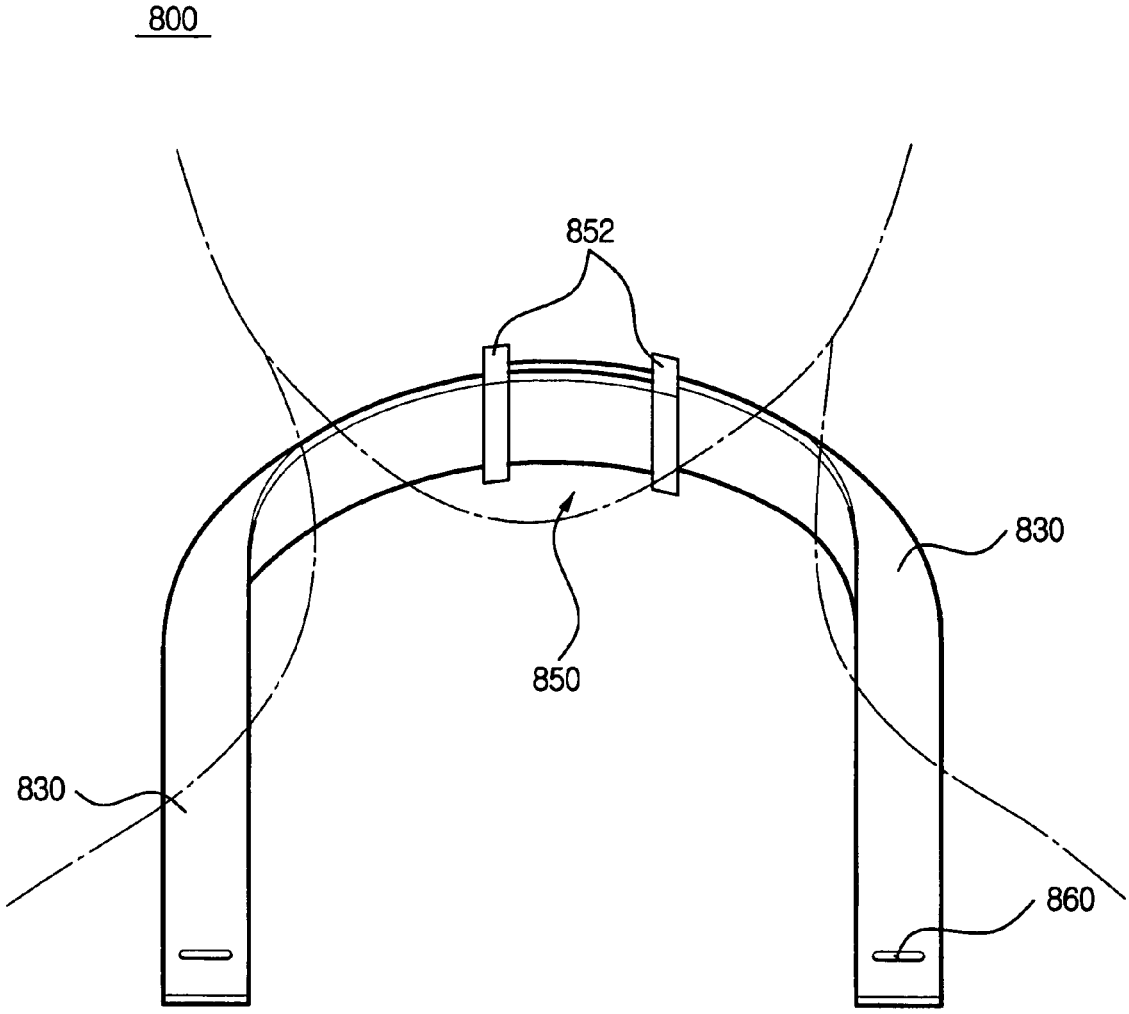
FIG. 11 is a perspective view illustrating a napkin holder according to a seventh embodiment of the present invention.

FIG. 11 is a perspective view illustrating a napkin holder according to the seventh embodiment of the present invention.

Referring to FIG. 11, two neck bands 830 are mutually engaged to provide a napkin holder 800. Each of the neck bands 830 has a fixing hole 860 formed at one end portion and a joint loop 852 formed at the other end portion. The napkin holder 800 of the present embodiment has several common points in some elements, in comparison with the napkin holder 700 of the sixth embodiment. However, the napkin holder 800 does not include an uneven portion. Instead of the uneven portion, the neck bands 830 maintain the status of contacting with each other, using their surface friction. Since the neck bands 830 are made of rubber material like silicone, they can have a considerable friction force. Thus, the user can adjust the length of the napkin holder 800 without the uneven portion.

In accordance with the present embodiment, the fixing holes 860 are positioned at end portions of the neck band 830 and are formed in a shape of a straight line. The fixing hole 860 can hold a napkin, a bib or a towel using elasticity or friction of the neck band 830.

As shown in FIG. 11, the two neck bands 830 are symmetrically engaged. More precisely, one neck band 830 passes the joint loop 852 of the other neck band 830 and the other neck band 830 passes the joint loop 852 of the one neck band 830. Though the neck band 830 does not include an uneven portion, the friction between the neck bands 830 can maintain the length of the napkin holder 800 without slip. To control the length of the napkin holder 800, the user can separate the neck bands 830 and adjust the overlapped length of the neck bands 830.

The napkin holder 800 includes a length adjusting section 850 for adjusting the length of the napkin holder, and the length adjusting section 850 may have the joint loop 852. According to the present embodiment, the joint loop 852 is a closed hole for passing the neck band 830, however, according to other embodiments, the joint loop may be partially open to be formed in a shape of alphabet letter "C".

A napkin holder includes a neck band, and the neck band includes fixing holes formed at its both end portions, respectively. A user can temporarily hold a napkin or a bib using the fixing holes, by a simple finger action of inserting the napkin or bib into the hole.

Also, since the napkin holder is made of elastic material like silicone or plastics, the cost of production is very low and the production facilities are already well-developed. Moreover, a napkin holder having a length adjusting section gives a user increasing convenience.

What is claimed is:

1. A napkin holder for holding a cloth protection piece, the napkin holder comprising:

an elongated neck band having a plurality of slits radially extending from a common aperture formed at each end and wearable around a neck of a living body, wherein the cloth protection piece is attachable to the neck band through each plurality of slits by inserting a portion of the cloth protection piece therethrough using a single finger such that the inserted portion of the cloth protection piece is held in the common aperture through frictional resistance therebetween, and wherein the portion of the elongated neck band having the common aperture is made from an elastic material to allow easy insertion of the finger therethrough and easy restoration of the slit shape after removal of the finger.

2. The napkin holder as claimed in claim 1, wherein the neck band is made from an elastic material including at least a highly polymerized compound or plastics.

3. The napkin holder as claimed in claim 1, wherein each slit is formed in a shape of wave or zigzag.

4. The napkin holder as claimed in claim 1, wherein at least one plurality of the slits is a V-shaped.

5. The napkin holder as claimed in claim 1, further comprising a length adjusting section for adjusting the length of the elongated neck band.

6. The napkin holder as claimed in claim 1, wherein a width of the elongated neck band at or near each end is broader than the width at the middle of the elongated neckband.

* * * * *